US006209807B1

(12) United States Patent
Hsin-Fa

(10) Patent No.: US 6,209,807 B1
(45) Date of Patent: Apr. 3, 2001

(54) QUICKLY INSTALLED SPRAY NOZZLE

(76) Inventor: Wang Hsin-Fa, 68 Mou Dan Lane, Jaw An Lee, Lou Kang Township, Chan Hua Hsien (TW)

( * ) Notice: Subject to any disclaimer, the term of this patent is extended or adjusted under 35 U.S.C. 154(b) by 0 days.

(21) Appl. No.: 09/114,715

(22) Filed: Jul. 13, 1998

(51) Int. Cl.[7] ..... B05B 1/00
(52) U.S. Cl. ..... 239/600
(58) Field of Search ..... 239/600, 288.3, 239/288.5, 391

(56) References Cited

U.S. PATENT DOCUMENTS 3,059,860 * 10/1962 Hohn ..... 239/600
4,641,786 * 2/1987 Moore ..... 239/600
4,936,511 * 6/1990 Johnson et al. ..... 239/600
5,190,224 * 3/1993 Hamilton ..... 239/600
5,253,807 * 10/1993 Newbegin ..... 239/600
5,727,739 * 3/1998 Hamilton ..... 239/600

* cited by examiner

*Primary Examiner*—David A. Scherbel
*Assistant Examiner*—Dinh Q. Nguyen
(74) *Attorney, Agent, or Firm*—Harrison & Egbert

(57) ABSTRACT

A quickly installed spray nozzle is composed of a nozzle holder which is provided at the top with a water outlet that extends with an appropriate distance connect tube which is provided with a protuberance piece at both sides of the outer wall, and a nozzle head extends to an appropriate length with a casing at one end thereof. The inner wall of said casing is matched with the diameter of the connect tube. The casing is provided with a guide trough and a wedge trough, and further provided with a washer at the end thereof. The nozzle head uses the casing to insert directly to the connect tube of the nozzle holder, so as to let the protuberance piece of the connect tube to come into the guide trough of inner wall casing. The nozzle head removes to an appropriate angle so as to let the protuberance piece insert into the wedge trough and reach the nozzle head to install quickly in place.

1 Claim, 5 Drawing Sheets

QUICKLY INSTALLED SPRAY NOZZLE

FIELD OF THE INVENTION

The present invention relates generally to a nozzle, and more particularly to a spray nozzle that can be installed quickly.

BACKGROUND OF THE INVENTION

As shown in FIG. 1, a prior art spray nozzle consists of a nozzle holder 10 and a nozzle head 11 which are engaged with each other. At the top of the nozzle holder 10 near to the water outlet 12 is formed an external thread 13, whereas inside of the nozzle head 11 is formed an internal thread. While changing or installing the nozzle head 11, the user will need to spend more time in swiveling between the nozzle head 11 and the nozzle holder 10 so as to engage with the water outlet 12.

Such a design is defective in that it is waste of time and needs to change the shapes of the nozzle head if the spray nozzle is required to have different forms and ranges in spraying.

SUMMARY OF THE INVENTION

The primary objective of the present invention is therefore to provide a quickly installed spray nozzle with a special device to the connect tube of the top nozzle holder and to the casing of the opposite nozzle head.

DETAILED DESCRIPTION OF THE EMBODIMENT

Figure 1:
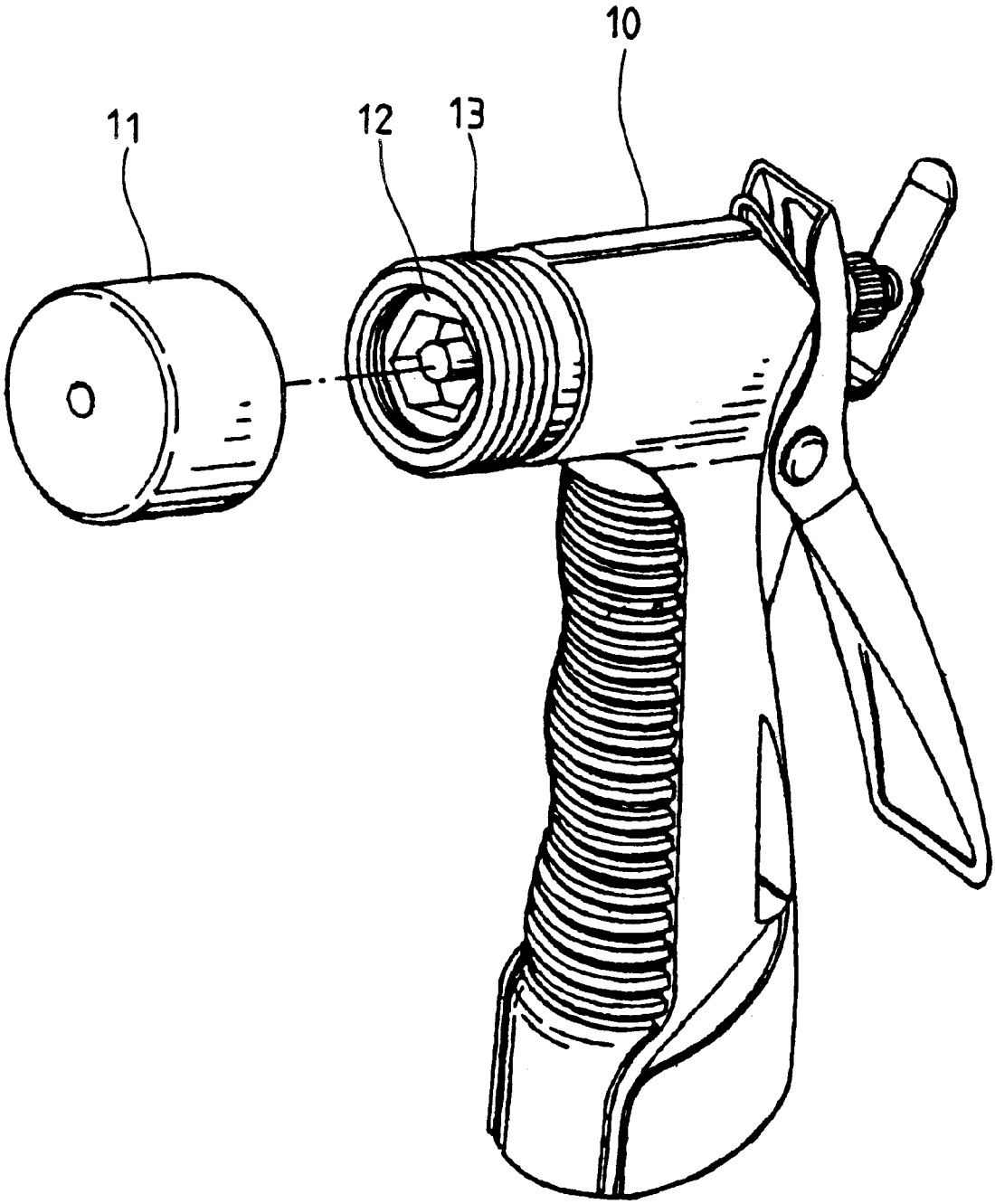
FIG. 1 shows an exploded view of the prior art spray nozzle.
Figure 2:
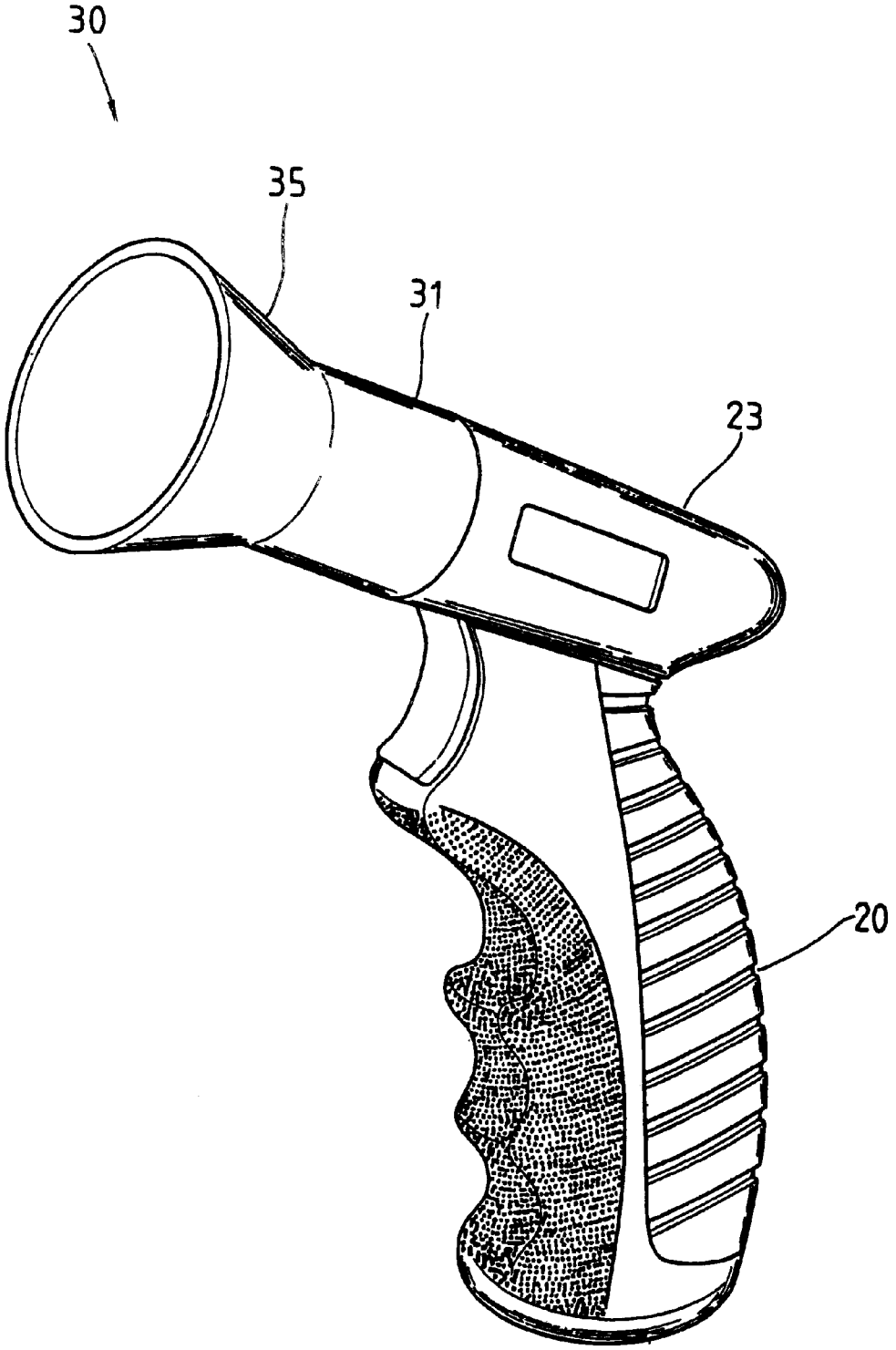
FIG. 2 shows a perspective view of the present invention.
Figure 3:
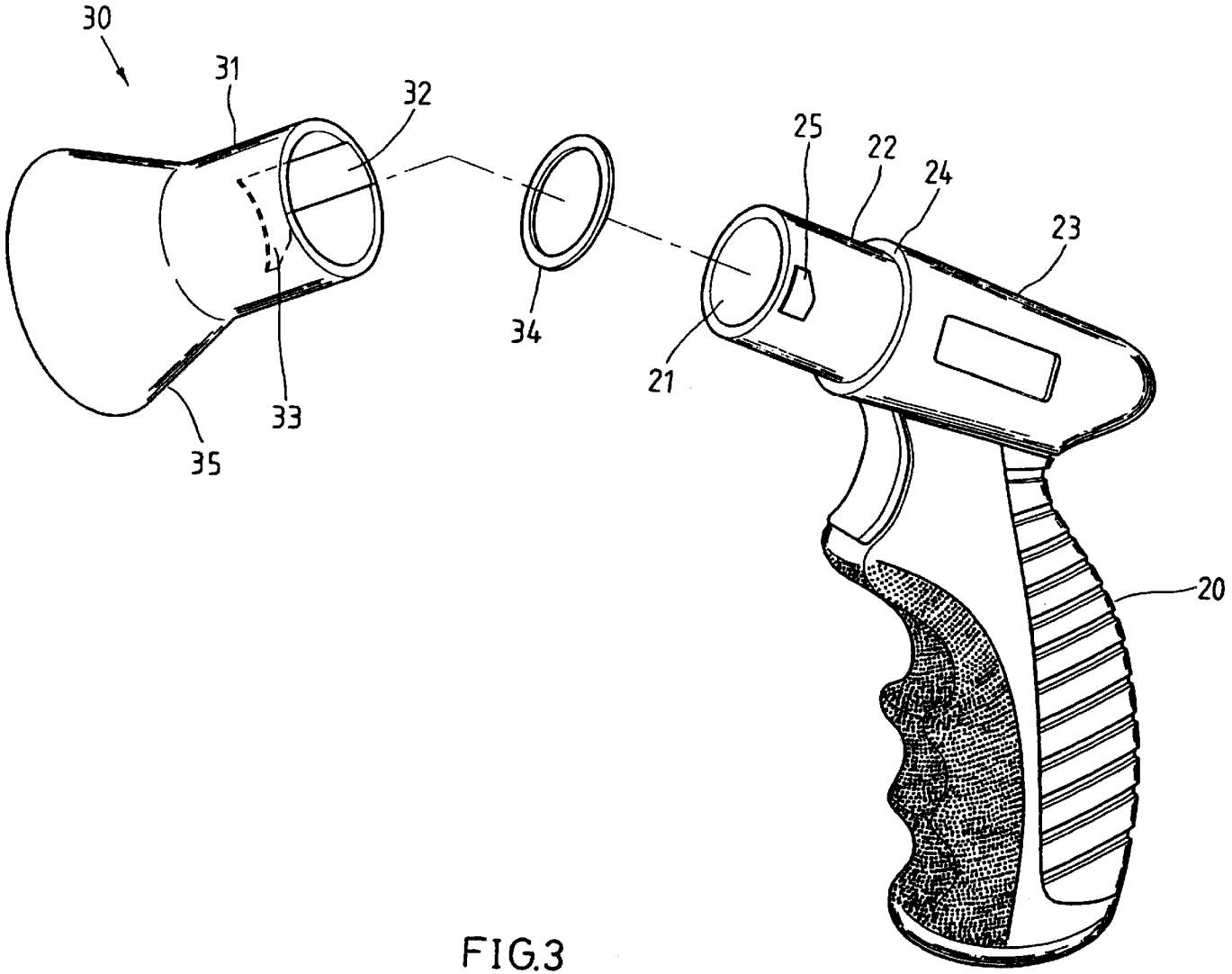
FIG. 3 shows an exploded view of the present invention.

As shown in FIGS. 2 and 3, a quickly installed spray nozzle embodied in the present invention is composed of the following items.

A nozzle holder 20 is provided at the top with a water outlet 21 which extends an appropriate distance by connect tube 22. The diameter of the connect tube 22 is smaller than the tube body 23 of the nozzle holder 20 at top end thereof, so as to form a shoulder 24 between the connect tube 22 and the tube body 23. A protuberance 25 is provided at both sides of the outer wall of the connect tube 22.

A nozzle head 30 extends an appropriate length to form a casing 31 at one end thereof. The inner diameter of the casing 31 is matched with the outer diameter of the connect tube 22. The inner wall of the casing 31 is further matched with the protuberance 25 of the connect tube 22 that extends inside by a horizontal guide trough 32 to the end of the casing 31. The end of the guide trough 32 is turned to be formed into a wedge trough 33. A washer 34 is provided inside of the casing 31 to seal with the shoulder (as shown in FIG. 4) 36 which formed at the intersection of the inner wall of the casing 31 and the trumpet portion 35.

Figure 4:
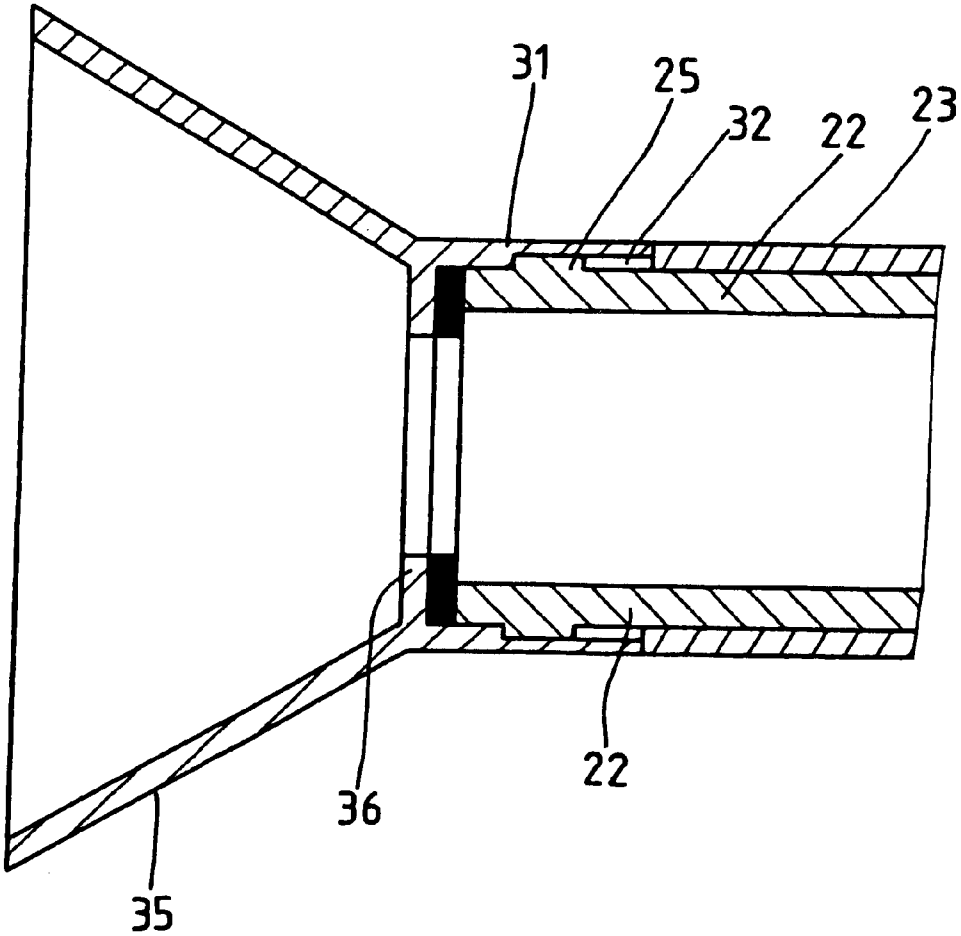
FIG. 4 shows a sectional view of the present invention in combination.
Figure 5:
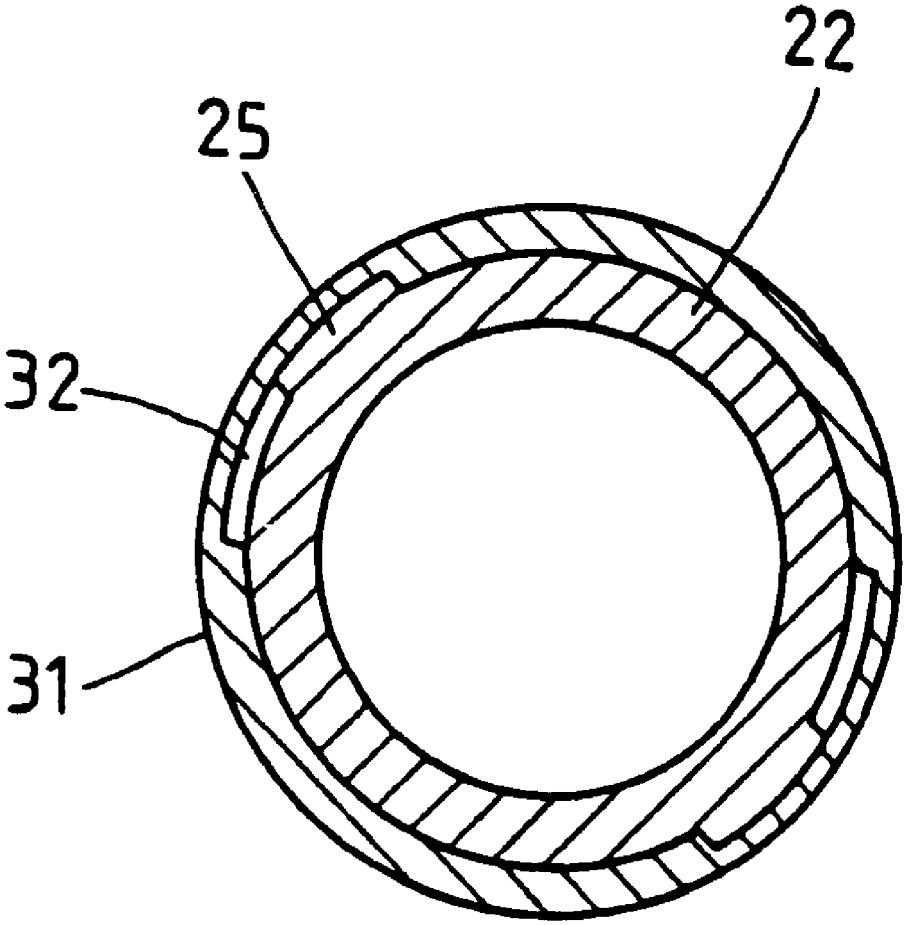
FIG. 5 shows a schematic view of the present invention of connecting in operation.

As shown in FIGS. 3–5, when the user would like to change or install the nozzle head 30, the casing 31 of the nozzle head 30 can face directly to the connect tube 22 of the nozzle holder 20 so that the protuberance 25 at the outer wall of the connect tube 22 aligns with the guide trough 32 in the inner wall of the casing 31. Furthermore, the connect tube 22 of the nozzle holder 20 inserts into the casing 31 of the nozzle head 30. The edge of the connect tube 22 presses against the washer 34 inside of the casing 31 at the end. The protuberance 25 is located at the juncture of guide trough 32 and wedge trough 33. The nozzle head 30 is turned for an appropriate distance, so as to enable the wedge trough 33 of the casing 31 to be positioned around the protuberance 25 when the protuberance is inserted into the wedge trough 33 so that the nozzle head 30 can be quickly installed and connected in place. If the nozzle head 30 needs to be changed, one only needs to turn the nozzle head 30 to the opposite side, so that the wedge trough 33 is separated from the protuberance 25 and the protrusion 25 is positioned in the guide trough 32. Then, the user can pull out directly the nozzle head 30. In the present invention, the nozzle head 30 can insert directly to, and it just needs to turn for one time, then the nozzle holder 20 can be quickly installed in the place.

The embodiment of the present invention described above is to be deemed in all respects as being illustrative and not restrictive. Accordingly, the present invention may be embodied in other specific forms without deviating from the spirit thereof. The present invention is therefore to be limited only by the scopes of the following appended claim.

What is claimed is:

1. A spray nozzle apparatus comprising:

a nozzle holder having a water outlet at a top thereof, said nozzle holder having a connect tube extending from a tubular body of said nozzle holder at said water outlet, said connect tube having a diameter smaller than a diameter of said tubular body, said nozzle holder having a shoulder formed at a juncture of said connect tube and said tubular body, said connect tube having protuberances respectively formed on opposite sides thereon, each of said protuberances having a wedge-shaped portion;

a nozzle head having a trumpet portion at one end and a casing at an opposite end thereof, said casing having an inner diameter matching an outer diameter of said connect tube, said casing having an inner wall with horizontal guide troughs formed therein on opposite sides thereof, each of said horizontal guide troughs opening at said opposite end of said nozzle head, said inner wall of said casing having wedge-shaped troughs formed respectively at an end of said horizontal guide troughs, said wedge-shaped troughs respectively removably receiving said wedge-shaped portion of each of said protuberances therein, said nozzle head having a shoulder formed interior thereof at a juncture of said trumpet portion and said casing; and a washer positioned within said nozzle head, said washer juxtaposed between said shoulder of said nozzle head and an end of said connect tube when said protuberances are received in said wedge-shaped troughs.

* * * * *